United States Patent [19]

Saitoh et al.

[11] Patent Number: 5,065,193

[45] Date of Patent: Nov. 12, 1991

[54] HEAT FIXING ROLL FOR COPYING MACHINE, METHOD OF PRODUCING THE SAME AND ELECTRONIC COPYING MACHINE PROVIDED WITH THE SAME

[75] Inventors: Hiroshi Saitoh, Funabashi; Michio Nagatomo; Hideo Nagasaka, both of Tokyo, all of Japan

[73] Assignee: Onoda Cement Co., Ltd., Onoda, Japan

[21] Appl. No.: 525,903

[22] Filed: May 18, 1990

[30] Foreign Application Priority Data

May 24, 1989 [JP] Japan ..... 1-131139

[51] Int. Cl.[5] ..... G03G 15/20

[52] U.S. Cl. ..... 355/290; 29/895; 219/216; 355/285

[58] Field of Search ..... 355/285, 289, 282, 290, 355/295; 219/216; 29/898.068, 895, 895.1, 895.2, 895.21, 895.211, 895.212, 895.213, 895.22, 895.23, 895.3, 895.31, 895.32, 895.33

[56] References Cited

U.S. PATENT DOCUMENTS 958,144 5/1910 Lockwood ..... 29/895.211
4,170,726 10/1979 Okuda ..... 219/121
4,743,940 8/1988 Nagasaka et al. ..... 219/216 X
4,806,731 2/1989 Bragard ..... 219/121.69
4,866,826 8/1989 Koide ..... 29/895.3

FOREIGN PATENT DOCUMENTS 0116584 5/1989 Japan ..... 355/289

*Primary Examiner*—Arthur T. Grimley
*Assistant Examiner*—Thu A. Dang
*Attorney, Agent, or Firm*—Price, Heneveld, Cooper, DeWitt & Litton

[57] ABSTRACT

A heat fixing roll for a copying machine includes an insulating layer formed on the surface of a hollow tube, a heating resistor layer formed on the surface of the insulating layer by uniformly thermal spray coating a resistor material, a screw-like heating resistor formed by forming a helical groove having a depth reaching the surface of the insulating layer by using a laser irradiation head connected to an electric resistance compensator, and an antisticking layer formed on the surface of the resistor and the groove by coating. The present invention also provides a method of producing the heat fixing roll and an electronic copying machine provided with the roll.

18 Claims, 4 Drawing Sheets

HEAT FIXING ROLL FOR COPYING MACHINE, METHOD OF PRODUCING THE SAME AND ELECTRONIC COPYING MACHINE PROVIDED WITH THE SAME

BACKGROUND OF THE INVENTION

The present invention relates to a heat fixing roll for so-called electronic copying machines such as electrostatic copying machines, laser printers and the like. The present invention also relates to a method of producing the roll.

Such a heat fixing roll is generally manufactured as shown in FIG. 7 to 9.

As shown in FIG. 7, an insulating layer 2 is formed on the surface of a hollow tube 1, and a metal wire 3 is helically wound on the insulating layer 2 formed, a heating resistor layer 4 being formed on the surface of the insulating layer 2 by thermal spray coating a resistor material. The metal wire 3 is then removed to form the screw-like heating resistor 4*a* shown in FIG. 8. As shown in FIG. 9, a reinforcing insulating layer 5 and an antisticking layer 6 are formed in turn on the surface of the heating resistor 4*a*.

Conventional fixing rolls for copying machines and the method of producing the rolls have the following problems:

(1) When the metal wire 3 is helically wound on the insulating layer 2 outside the hollow tube, the hollow tube is rotated so that the metal wire 3 closely adheres to the insulating layer 2, and the metal wire 3 is tensed so as not to slide thereon and is moved at a predetermined speed along the hollow tube while being balanced so as not to be cut.

The winding work is therefore complex and delicate and thus takes much time, as well as being incapable of easily winding the wire 3 in accordance with setting.

(2) Since the metal wire 3 does not closely adhere to the insulating layer 2, if the wire size of the metal wire 3 is, for example, 100 to 200 μm, since the adjacent portions of the groove formed are incompletely separated from each other at the bottom, the adjacent portions of the heating resistor are sometimes connected to each other at the bottom. In order to prevent the connection at the bottoms of the groove, it is necessary to use a metal wire having a large size, for example, 350 to 700 μm.

However, the use of such a thick metal wire causes the formation of a groove having a width of 400 to 700 μm and thus often causes the formation of a depressed helical line 6*a* on the surface of the antisticking layer 6.

In order to remove such a depressed line 6*a*, it is therefore necessary to grind the surface of the antisticking layer 6 until the smooth plane 6*b* shown by a one-dot chain line in FIG. 9 is formed.

The antisticking layer 6 must be thus coated so as to have a thickness which is greater than the required thickness by a thickness corresponding to the layer to be ground. In addition, the need for the grinding process causes an increase in production cost.

SUMMARY OF THE INVENTION

In consideration of the above-described situation, it is an object of the present invention to simply produce a heat fixing roll for a copying machine at low cost. It is another object of the present invention to reduce dispersion in the heating values of the roll products and increase the rate of non-defective products.

In order to achieve the objects, the present invention provides a heat fixing roll comprising an insulator layer and a heating resistor layer, which are formed in turn on the outside of a hollow tube; a groove which is helically formed in the heating resistor layer by laser cutting so that the insulator layer is exposed; a screw-like heating resistor having adjacent portions divided by the groove; and an antisticking layer for covering the heating resistor and the groove. The present invention also provide a production method comprising the steps of covering the outer peripheral surface of a hollow tube with an insulator layer; forming a heating resistor layer on the surface of the insulator layer; forming a helical groove in the heating resistor layer by using a laser to form a heating resistor; and forming an antisticking layer for covering the heating resistor and the groove.

BRIEF DESCRIPTION OF THE DRAWINGS

FIGS. 1 to 6 are drawings of an embodiment of the present invention in which:

FIG. 1 is a sectional view of the embodiment at the end of processing of an antisticking layer, FIG. 2 is a front view of the embodiment during the formation of a resistor layer by spray coating, FIG. 3 is a front view of the embodiment during the formation of a groove by laser processing, FIG. 4 is a partially sectional front view of the embodiment when the electrical resistance of a resistor layer is measured;

FIG. 5 is a sectional view of the embodiment at the end of processing of power supplying parts and the antisticking layer; and FIG. 6 is a sectional view of the embodiment when no reinforcing insulating layer is provided; and FIGS. 7 to 9 are drawings of a conventional roll in which:

FIG. 7 is a sectional view of the same after the formation of a heating resistor layer by thermal spray coating;

FIG. 8 is a sectional view of the same after the removal of a metal wire; and FIG. 9 is a sectional view of the same at the end of processing of an antisticking layer.

DETAILED DESCRIPTION OF PREFERRED EMBODIMENTS

Figure 1:
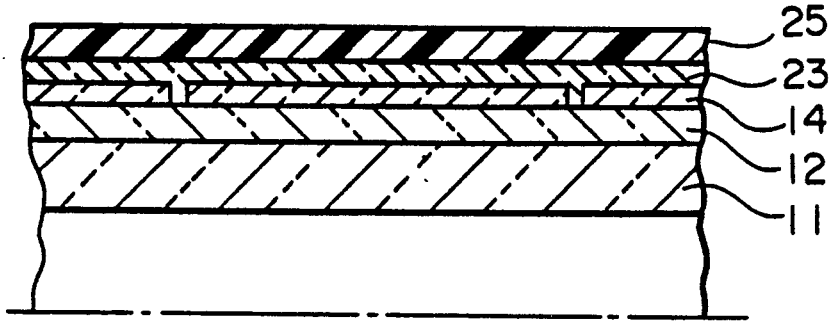

Although the present invention is described below with reference to the attached drawings, the same reference numeral denotes the same member having the same function.

Figure 2:
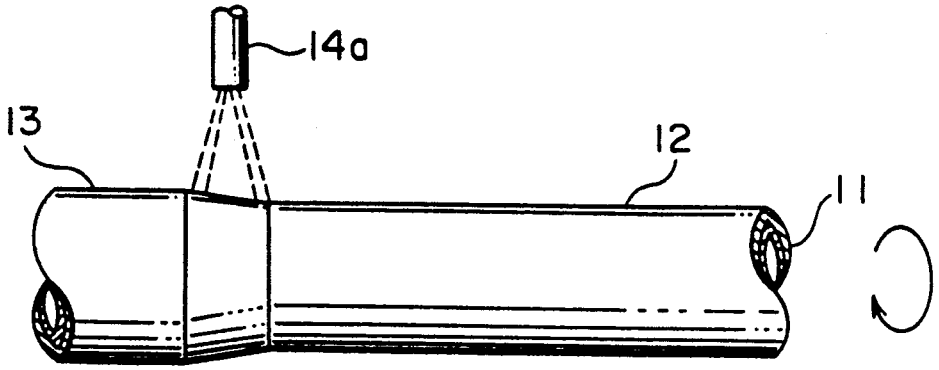

An insulating layer 12 is formed in a thin layer having a thickness of, for example, about 200 μm, on the surface of a hollow metal tube 11 by plasma thermal spray coating alumina, magnesia alumina spinel or the like using a thermal spray coating torch 14*a* while rotating the hollow tube 11, as shown in FIG. 2. A resistor layer 13 is then formed in a thin layer having a thickness of, for example, about 30 to 100 μm, on the surface of the insulating layer 12 by plasma thermal spray coating nichrome, stainless, aluminum, aluminum alloy brazing filler metals, a titania-chromia mixture, a titania-nichrome mixture, a silica-alumina-nickel mixture or the like using the spray coating torch 14*a*. Nichrome aluminum containing 6% of aluminum relative to the total of nichrome consisting of 80% of nickel and 20% of chromium is excellent as a resistor material.

(1) When a power source is connected to both ends of the heating resistor layer so as to cause electric current to flow through the heating resistor layer and increase the temperature thereof by heating, if nichrome aluminum (NiCr.Al) is used as a material for the heating resistor, only a slight difference occurs between the electric resistance values at the starting time of electrical charge of the resistor and the time the temperature reaches a predetermined value, for example, 200° C., because the temperature coefficient of the resistor is as low as 100 to 300 PPM. There is thus no problem in that a fuse is blown owing to a large current flowing at the start of electrical charge, or in that the temperature rising time of the heating element is long owing to a low current flowing at the start of electrical charge.

(2) Fluorine resin is frequently used in the antisticking layer, and the baking temperature thereof is about 360 to 400° C. The electric resistance value of NiCr.Al is not changed by baking at such a relatively high temperature.

In addition, although a heat fixing roll is on-off controlled so as to be kept at a temperature of about 200° C., the electric resistance value of NiCr.Al is stable even if a heat fixing roll is operated for a long time at the above high temperature.

Aluminum can be appropriately mixed within the range of 0.5 to 4% relative to nichrome The components of nichrome are also not limited to the above-described mixing ratio.

Figure 3:
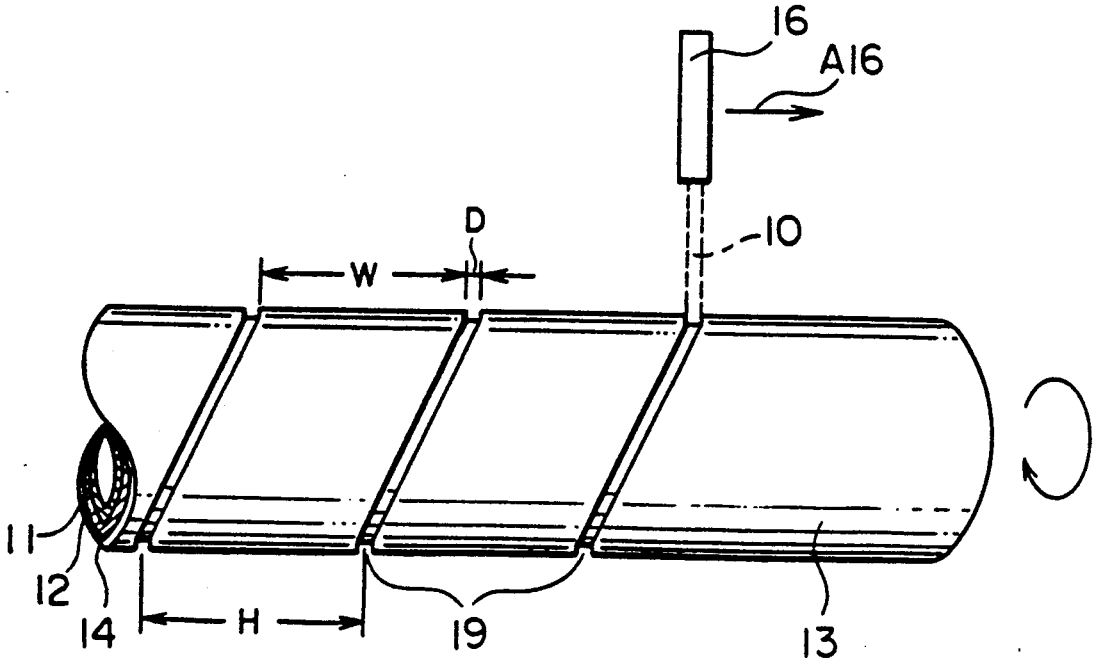

As shown in FIG. 3, the hollow tube 11 is rotated while a laser irradiation head 16 being moved in the direction shown by the arrow A16 in the drawing. When a laser beam 10 converged to a narrow beam, for example, a YAG laser beam, is applied to the surface of the resistor layer 13, which is made of a metal or mainly made of a metal, is heated by the laser beam 10 so that a portion of the resistor layer 13 to which the laser beam 10 is applied is evaporated.

Since the insulating layer 12 is made of ceramics such as alumina, magnesia-alumina spinel or the like, as described above, it has a melting point and a boiling point, and thus phase transition temperatures, which are higher than those of metals. The output of the laser beam 10 and the irradiation time can thus be regulated so that the insulating layer 12 is hardly worn out, while the irradiated portion of the resistor layer is evaporated, whereby the surface of the insulating layer 12 can be exposed at the bottom of a groove 19.

The helical groove 19 can be formed with parallel portions at predetermined distances H by controlling the speed of movement of the laser irradiation head 16 and the rotational speed of the hollow tube 11.

The distance H between the adjacent parallel portions of the groove 19 is determined by the resistivity value, the thickness, the required heating value and so on of the resistor layer 13 and is about 2 to 10 mm.

The width D of the groove 19 is about 100 to 200 μm.

When many heat fixing rolls are produced, if the electric resistance value between both ends of each of the heating resistors 14 is out of a predetermined range, i.e., if the values vary, the rate of nondefective products is decreased.

The electric resistance value is affected by the thickness of the resistor layer 13, the width W of the screw-like heating resistor 14 and the conditions of thermal spray coating.

Figure 4:
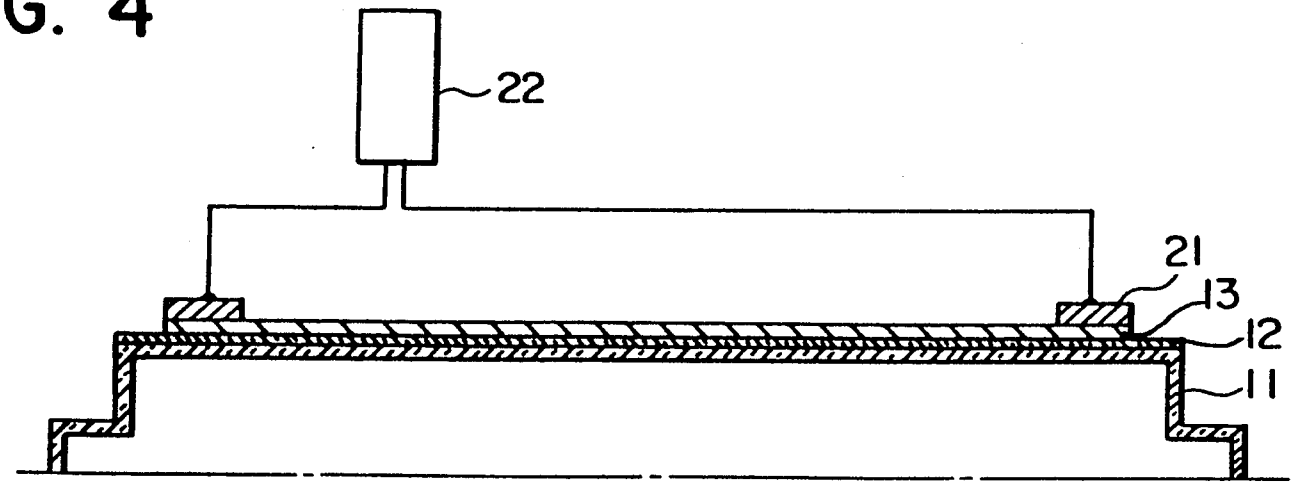

Although the width W of the heating resistor 14 can be precisely controlled by a method using the above-described laser beam, it is very difficult to maintain a constant thickness of the resistor layer 13 and constant conditions of spray coating during the operation of a production apparatus over a long time and thus difficult to increase the rate of nondefective products. However, this problem can be resolved by the following method:

The resistor layer 13 is first formed in such a manner that the thickness of the resistor layer 13 is as constant as possible, and the conditions of thermal spray coating are also constant. Power supplying parts 21 are then formed at both ends of the resistor layer 13, and the measuring terminals of resistance measuring instrument of an electric resistance compensator are brought into contact with the power supplying parts 21, as shown in FIG. 4.

In this way, the electric resistance value between both ends of the heating resistor layer 13 can be precisely measured by measuring the resistance using the power supplying parts 21.

If the result of measurement deviates from a standard value, the width W of the heating resistor 14 can be determined by calculation so that the electric resistance value between both ends of the heating resistor layer 13 is a predetermined value in correspondence with the value obtained measurement.

Although the calculating method is not described below, the electric resistance value decreases with an increase in width W of the heating resistor 14 and conversely increases with a reduction in width W.

The rotational speed of the hollow tube 11 and the moving speed of the laser irradiation head 16 are thus programmed so that the width W of the heating resistor 14 determined by calculation can be obtained. The groove 19 with a depth reaching the surface of the insulating layer 12 is formed by helically cutting the resistor layer 13 by using the laser beam in accordance with the program formed As a result of laser trimming, the dispersion of the electric resistance values of the heating resistors 14 can be restricted to a value within the range of +5%.

Figure 5:
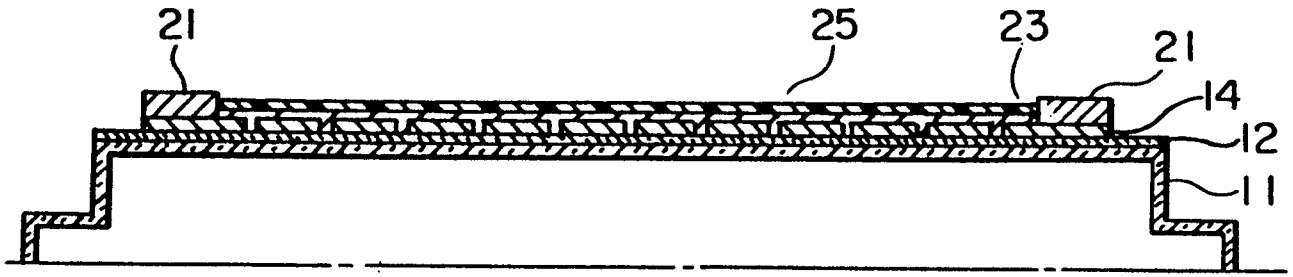

As a matter of course, a series of processes (laser trimming) such as the measurement of the electric resistance value of the resistor layer 13, the calculation of the width of the heating resistor 14, the calculation of the rotational speed of the hollow tube, the moving speed of the laser irradiation head 16, the programming and other executions are automatically carried out. After the groove 19 has been formed, the reinforcing insulating layer 23 is formed on the surface of the heating resistor 14 and on the internal surface of the groove 19, as shown in FIG. 5. In this case, the reinforcing insulating layer 23 is formed by a method of plasma spray coating a ceramics material such as alumina, magnesia-alumina spinel or the like so that the thickness thereof is 100 to 250 μm.

When no power supplying part is disposed on the resistor layer 13, the power supplying parts 21 are formed at both ends of the heating resistor 14, as shown in FIG. 5. The heating parts 21 are formed by a method of spray coating or plasma thermal spray coating a conductive material such as copper, a copper alloy or the like.

The antisticking layer 25 is then formed on the reinforcing insulating layer 23 by a method of powder coating fluorine resin such as PFA or the like.

The material for the antisticking layer 25 is not limited to the fluorine resin such as PFA or the like, and silicone and other resins having excellent antisticking properties can be used as materials for the antisticking layer 25. The method of forming the antisticking layer 25 is not limited to the power coating method, and other known liquid coating methods can be employed.

Figure 6:
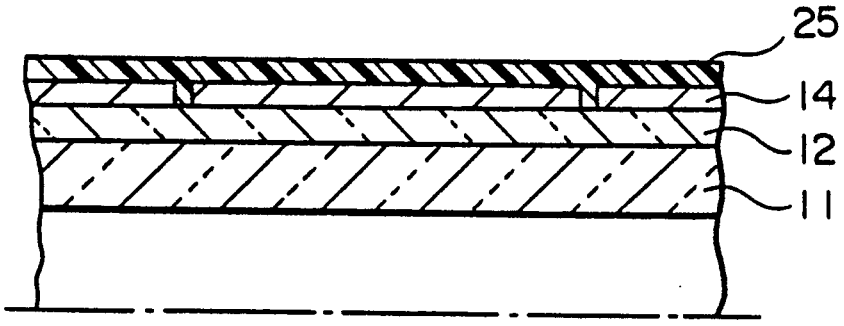
Figure 7:
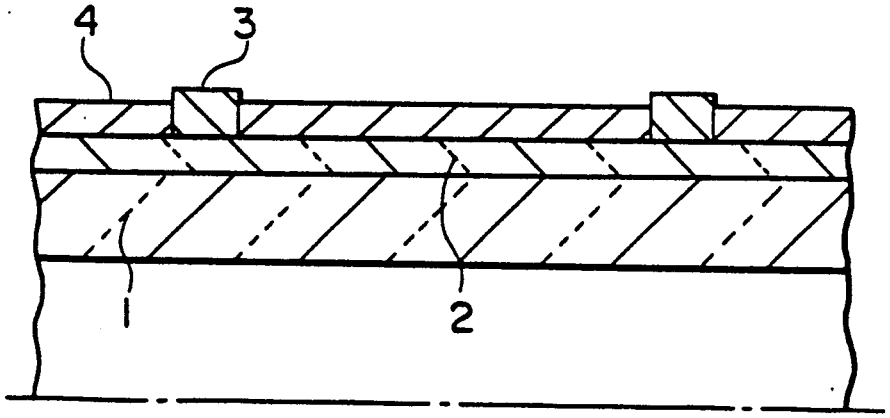
FIG. 7 (PRIOR ART)
Figure 8:
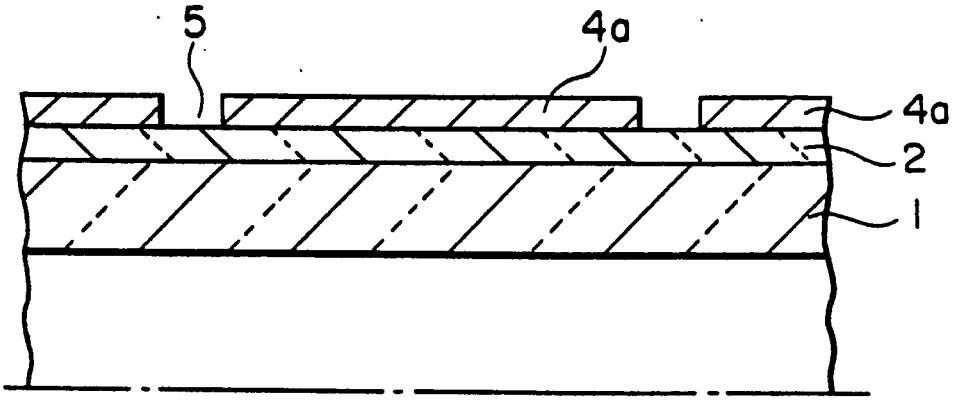
FIG. 8 (PRIOR ART)
Figure 9:
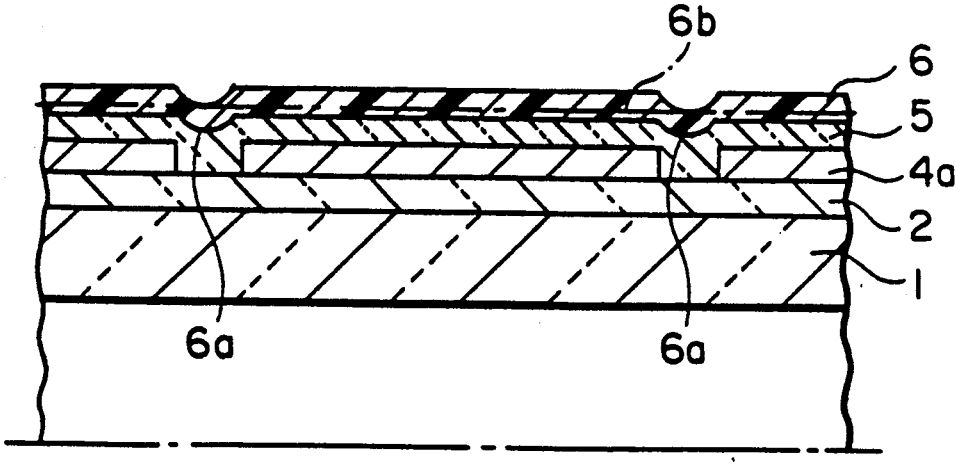
FIG. 9 (PRIOR ART)

When the antisticking layer 25 has a high level of electrical insulating properties, the antisticking layer 25 is sometimes formed directly on the surface of the heating resistor 14 without the reinforcing insulating layer 23 disposed thereon, as shown in FIG. 6.

In this way, the direct heating-type heat fixing roll can be manufactured at a low cost with a high rate of nondefective products.

When the groove 19 is formed by using the laser beam 10, the width D of the groove 19 can be reduced to 100 to 200 μm, as described above. Even if the antisticking layer 25 or the reinforcing insulating layer 23 and the antisticking layer 25 are formed, therefore, there is no problem of occurring a depressed line because the groove 19 is filled with small amounts of the antisticking material and the reinforcing insulating material.

The antisticking layer 25 thus has a smooth surface and need not be ground.

As described above, since the present invention employs the laser beam for forming the helical groove 19 in the heating resistor layer so that the insulating layer is exposed to air, it is possible to reduce the width of the groove and completely separate the adjacent portions of the heating resistor from each other.

It is therefore unnecessary to wind and remove the metal wire, and no depressed stripe occurs in the antisticking layer, apart from conventional fixing rolls. Since the surface of the antisticking layer 25 need not be ground, the production cost can be reduced. In addition, the positioning of the helical groove 19 using the electric resistance compensator enables a reduction in dispersion of the electric resistance value of the heat fixing roll produced and an increase in the rate of nondefective products.

Further, an electronic copying machine provided with a heat fixing roll for copying machines, which has the helical heating resistor layer formed by laser cutting, is capable of uniformly controlling the temperature distribution on the roll. Uniformity therefore occurs between the central portion and both ends of the image copied, and a uniform and clear image can be copied.

An electronic copying machine provided with a heating fixing roll for a copying machine which has the helical nichrome-aluminum heating resistor layer formed by laser cutting has the aforementioned effect and comprises the heating resistor which has a low temperature coefficient and uniformly generates heat at the start of electrical charge and during stationary use. It is therefore possible to ensure that the allowable power consumed (heating value) by the heat fixing roll for a copying machine is always kept at the maximum and to obtain the following effects:

(1) Since the rising time of a copying machine is short, a waiting time from the time a switch is turned on can be reduced.

(2) The heating value is not reduced during stationary use, as described above, and heat is easily supplied to the heating resistor in correspondence with the heat required for fixing It is therefore possible to significantly increase the amount of copying paper (the number of sheets of copying paper per unit time). Namely, it is possible to improve the copying ability of the copying machine.

What is claimed is:

1. A heat fixing roll for a copying machine comprising:

an insulator layer and a heating resistor layer which are formed in turn on the outside of a hollow tube;

a helical groove which is formed in said heating resistor layer by laser cutting so that said insulator layer is exposed to air, said heating resistor layer having a lower phase transition temperature than said insulator layer whereby said laser forms said groove without damage to said insulator layer, said groove having a width less than 350 μm;

said heating resistor layer including a screw-like heating resistor having adjacent portions divided by said groove; and an antisticking layer formed by coating said heating resistor and said groove with an antisticking agent whereby the outer surface of said antisticking layer is smooth.

2. A heat fixing roll for a copying machine comprising:

an insulator layer and a heating resistor layer which are formed in turn on the outside of a hollow tube;

a helical groove which is formed in said heating resistor layer by laser cutting so that said insulator layer is exposed to air, said groove having a width less than 350 μm;

said insulator layer having a higher phase transition temperature than said resistor layer whereby said laser forms said groove in said heating resistor layer without damage to said insulator layer;

said heating resistor layer including a screw-like heating resistor having adjacent portions divided by said groove;

a reinforcing insulating layer for covering said heating resistor and said groove; and an antisticking layer formed by coating the surface of said reinforcing insulating layer with an antisticking agent whereby the outer surface of said antisticking layer is smooth.

3. A heat fixing roll for a copying machine according to claim 2, wherein said heating resistor layer is made of nichrome aluminum.

4. A method of producing a heat fixing roll for a copying machine comprising the steps of:

covering the external peripheral surface of a hollow tube with an insulator layer;

forming a heating resistor layer on the surface of said insulator layer, said insulator layer having a higher phase transition temperature than said heating resistor layer;

forming a heating resistor by forming a helical groove in said heating resistor layer using a laser which forms the groove in said resistor layer without damage to said insulator layer, the higher phase transition temperature of the insulator layer protecting the insulator layer when the laser forms the groove in the resistor layer; and forming an antisticking layer by coating the surface of the heating resistor and groove with an antisticking agent, the width of the groove such that the antisticking layer is formed without an indentation over the groove, whereby an outer layer is formed which does not have indentations without a step of grinding the surface of the antisticking layer.

5. A method of producing a heat fixing roll for a copying machine according to claim 4, wherein the position of said groove is determined by using an electric resistance compensator.

6. A method of producing a heat fixing roll for a copying machine according to claim 4, wherein said electric resistance compensator comprises means for measuring the electric resistance between both ends of said heating resistor layer.

7. A method of producing a heat fixing roll for a copying machine comprising the steps of:

covering the external peripheral surface of a hollow tube with an insulator layer;

forming a heating resistor layer on the surface of said insulator layer;

forming a heating resistor by forming a helical groove having a width of less than 350 μm in said heating resistor layer using a laser;

forming a reinforcing insulating layer for covering said heating resistor and said groove; and forming an antisticking layer by coating the surface of said reinforcing insulating layer with an antisticking agent, whereby the outer surface of said antisticking layer is smooth.

8. The method as defined in claim 7, wherein said insulator layer has higher phase transition temperatures than said heating resistor layer whereby an emission from said laser which vaporizes said resistor layer to form said groove does not damage said insulating layer when said emission contacts said insulating layer.

9. An electronic copying machine provided with a heat fixing roll for a copying machine comprising:

an insulator layer and a heating resistor layer which are formed in turn on the outside of a hollow tube;

a helical groove having a width of less than 350 μm which is formed in said heating resistor layer by laser cutting so that said insulator layer is exposed to air;

said heating resistor layer comprising a screw-like heating resistor having adjacent portions divided by said groove; and an antisticking layer formed by coating said heating resistor and said groove with an antisticking agent, whereby said outer layer of said antisticking agent is smooth.

10. The method as defined in claim 9, wherein said insulator layer has higher phase transition temperatures than said heating transistor layer whereby an emission from said laser which vaporizes said resistor layer to form said groove does not damage said insulating layer when said emission contacts said insulating layer.

11. An electronic copying machine provided with a heat fixing roll for a copying machine comprising:

an insulator layer formed on the outside of a hollow tube;

a nichrome aluminum heating resistor covering said insulator layer;

a helical groove having a width of less that 350 μm which is formed in said heating resistor layer by laser cutting through said heating resistor layer to said insulator layer;

a screw-like heating resistor having portions divided by said groove; and an antisticking layer formed by coating said heating resistor and said groove with an antisticking agent, whereby said outer layer of said antisticking agent is smooth.

12. The method as defined in claim 11, wherein said insulator layer has higher phase transition temperatures than said heating resistor layer whereby an emission from said laser which vaporizes said resistor layer to form said groove does not damage said insulating layer when said emission contacts said insulating layer.

13. An electronic copying machine provided with a heat fixing roll for a copying machine comprising:

an insulator layer and a heating resistor layer which are formed in turn on the outside of a hollow tube;

a helical groove having a width of less than 350 μm which is formed in said heating resistor layer by laser cutting so that said insulator layer is exposed to air;

said heating resistor layer comprising a screw-like heating resistor having portions divided by said groove;

a reinforcing insulating layer for covering said heating resistor and said groove; and an antisticking layer formed by coating the surface of said reinforcing insulating layer with an antisticking agent, whereby the outer surface of said antisticking layer is smooth.

14. The method as defined in claim 13, wherein said insulator layer has higher phase transition temperatures than said heating resistor layer whereby an emission from said laser which vaporizes said resistor layer to form said groove does not damage said insulating layer when said emission contacts said insulating layer.

15. A heat fixing roll for a copying machine comprising:

an insulator layer and a heating resistor layer which are formed in turn on the outside of a hollow tube;

a helical groove which is formed in said heating resistor layer by laser cutting so that said insulator layer is exposed to air, said heating resistor layer having a lower phase transition temperature than said insulator layer whereby said laser forms said groove without damage to said insulator layer, said groove having a width less than 200 μm;

said heating resistor layer including a screw-like heating resistor having adjacent portions divided by said groove; and an antisticking layer formed by coating said heating resistor and said groove with an antisticking agent whereby the outer surface of said antisticking layer is smooth.

16. A heat fixing roll for a copying machine comprising:

an insulator layer and a heating resistor layer which are formed in turn on the outside of a hollow tube;

a helical groove which is formed in said heating resistor layer by laser cutting so that said insulator layer is exposed to air, said groove having a width less than 200 μm;

said insulator layer having a higher phase transition temperature than said resistor layer whereby said laser forms said groove in said heating resistor layer without damage to said insulator layer;

said heating resistor layer including a screw-like heating resistor having adjacent portions divided by said groove;

a reinforcing insulating layer for covering said heating resistor and said groove; and an antisticking layer formed by coating the surface of said reinforcing insulating layer with an antisticking agent whereby the outer surface of said antisticking layer is smooth.

17. A method of producing a heat fixing roll for a copying machine comprising the steps of:

covering the external peripheral surface of a hollow tube with an insulator layer;

forming a heating resistor layer on the surface of said insulator layer, said insulator layer having a higher phase transition temperature than said heating resistor layer;

forming a heating resistor by forming a helical groove in said heating resistor layer using a laser which forms the groove in said resistor layer without damage to said insulator layer, the higher phase transition temperature of the insulator layer protecting the insulator layer when the laser forms the groove in the resistor layer, said groove having a width less than 350 μm; and forming an antisticking layer by coating said heating resistor and said groove with an antisticking agent whereby said outer surface of said antisticking layer is smooth.

18. A method of producing a heat fixing roll for a copying machine comprising the steps of:

covering the external peripheral surface of a hollow tube with an insulator layer;

forming a heating resistor layer on the surface of said insulator layer, said insulator layer having a higher phase transition temperature than said heating resistor layer;

forming a heating resistor by forming a helical groove in said heating resistor layer using a laser which forms the groove in said resistor layer without damage to said insulator layer, the higher phase transition temperature of the insulator layer protecting the insulator layer when the laser forms the groove in the resistor layer, said groove having a width less than 200 μm; and forming an antisticking layer by coating said heating resistor and said groove with an antisticking agent whereby said outer surface of said antisticking layer is smooth.

* * * * *

UNITED STATES PATENT AND TRADEMARK OFFICE

CERTIFICATE OF CORRECTION

PATENT NO. : 5,065,193

DATED : November 21, 1991

INVENTOR(S) : Hiroshi Saitoh et al.

It is certified that error appears in the above-identified patent and that said Letters Patent is hereby corrected as shown below:

Column 3, line 27:
After "nichrome" insert --.--;

Column 4, line 37:
After "formed" insert --.--;

Column 5, line 66:
After "fixing" insert --.--;

Column 7, claim 9, line 44:
"agent" should be --layer--;

Column 7, claim 11, line 59:
"that 350" should be --than 350--.

Signed and Sealed this

Twenty-second Day of June, 1993

*Attest:*

Michael K. Kirk

MICHAEL K. KIRK

*Attesting Officer*

*Acting Commissioner of Patents and Trademarks*